US009708171B1

(12) United States Patent
Highum et al.

(10) Patent No.: US 9,708,171 B1
(45) Date of Patent: Jul. 18, 2017

(54) WATER COOLER STAND

(71) Applicants: Jon Highum, El Cajon, CA (US); Denise Highum, El Cajon, CA (US)

(72) Inventors: Jon Highum, El Cajon, CA (US); Denise Highum, El Cajon, CA (US)

( * ) Notice: Subject to any disclaimer, the term of this patent is extended or adjusted under 35 U.S.C. 154(b) by 0 days.

(21) Appl. No.: 15/057,773

(22) Filed: Mar. 1, 2016

(51) Int. Cl.
*B67D 3/00* (2006.01)

(52) U.S. Cl.
CPC ..... *B67D 3/0083* (2013.01); *B67D 3/009* (2013.01)

(58) Field of Classification Search
CPC ..... B67D 3/0083; B67D 3/009
See application file for complete search history.

(56) References Cited

U.S. PATENT DOCUMENTS

| | | | | |
|---|---|---|---|---|
| 128,956 | A | 7/1872 | Fellows | |
| D290,914 | S | 7/1987 | Carlson | |
| 4,699,342 | A | 10/1987 | Bartz | |
| 7,350,671 | B2 | 4/2008 | Mika | |
| 8,231,030 | B2 | 7/2012 | Lassota | |
| 2002/0040585 | A1* | 4/2002 | Chaney | B67D 1/0009 62/237 |
| 2003/0034359 | A1* | 2/2003 | Lassota | B67D 1/06 222/185.1 |
| 2007/0187435 | A1* | 8/2007 | Quirk | B67D 3/0009 222/481 |
| 2008/0035241 | A1* | 2/2008 | Wittbold | A01K 7/06 141/361 |
| 2008/0121766 | A1* | 5/2008 | Jorgensen | B67D 3/0083 248/150 |
| 2014/0252040 | A1* | 9/2014 | Shoup | B67D 3/0083 222/160 |

FOREIGN PATENT DOCUMENTS

| | | | | |
|---|---|---|---|---|
| DE | 202011051397 | U1 * | 11/2011 | B67D 3/0083 |
| DE | 202014002290 | U1 * | 4/2014 | B67D 3/0083 |
| DE | 202015004242 | U1 * | 9/2015 | B67D 3/0009 |
| WO | 2006084459 | A1 | 8/2008 | |

* cited by examiner

*Primary Examiner* — Frederick C Nicolas
*Assistant Examiner* — Bob Zadeh
(74) *Attorney, Agent, or Firm* — Kyle A. Fletcher, Esq.

(57) ABSTRACT

The water cooler stand is adapted for use with a five gallon beverage coolers. The water cooler stand is a cylindrical structure that is adapted to rest on a surface and receive the five gallon beverage cooler such that it raises the five gallon beverage cooler off the resting surface. The water cooler stand has formed in it a cup opening that is sized to allow a cup to be placed underneath the spigot such that liquids released from the cooler through the spigot will fall into the center of a beverage cup. When not in use, the water cooler stand can be stored on the five gallon beverage cooler. The water cooler stand comprises a capped cylinder, a cup opening, a non-skid surface, a plurality of hook and loop fasteners, a flared edge, and a safety edge.

14 Claims, 4 Drawing Sheets

FIG. 2
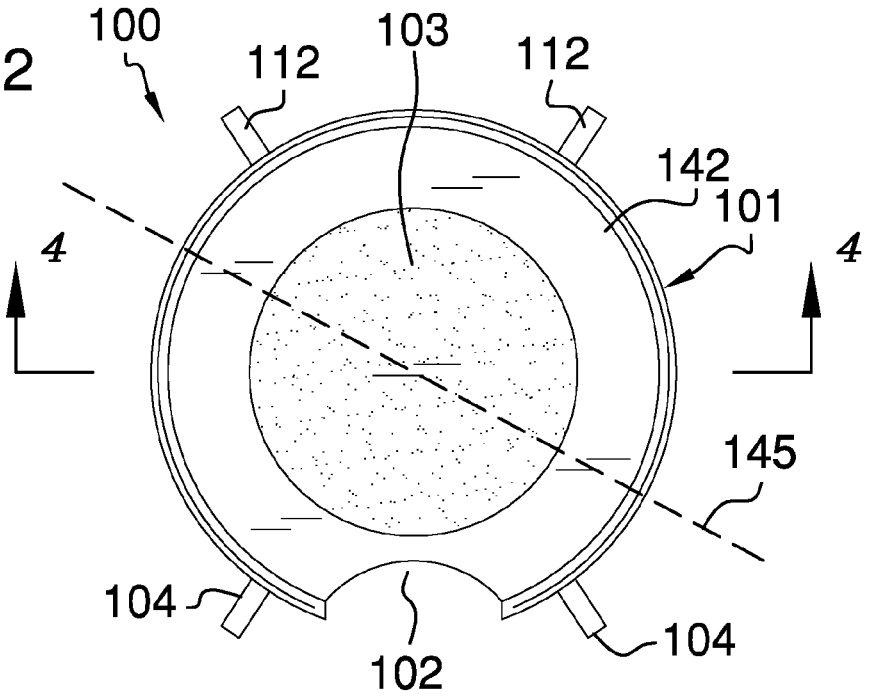
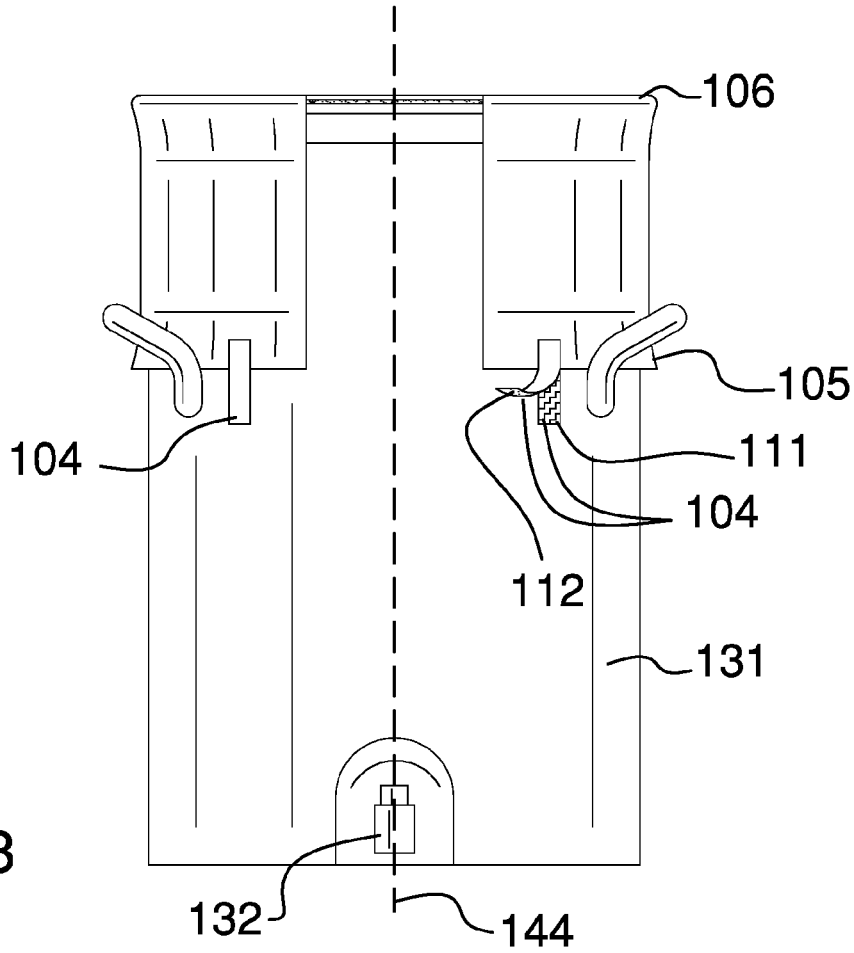
FIG. 3

WATER COOLER STAND

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of frames, casings, or beddings for apparatus, more specifically, a portable stand adapted for use with beverage coolers.

SUMMARY OF INVENTION

The water cooler stand is adapted for use with a five gallon beverage coolers. The water cooler stand is a cylindrical structure that is adapted to rest on a surface and receive the five gallon beverage cooler such that it raises the five gallon beverage cooler off the resting surface. The water cooler stand has formed in it a cup opening that is sized to allow a cup to be placed underneath the spigot such that liquids released from the cooler through the spigot will fall into the center of a beverage cup. When not in use, the water cooler stand can be stored on the five gallon beverage cooler.

These together with additional objects, features and advantages of the water cooler stand will be readily apparent to those of ordinary skill in the art upon reading the following detailed description of the presently preferred, but nonetheless illustrative, embodiments when taken in conjunction with the accompanying drawings.

In this respect, before explaining the current embodiments of the water cooler stand in detail, it is to be understood that the water cooler stand is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the water cooler stand.

It is therefore important that the claims be regarded as including such equivalent construction insofar as they do not depart from the spirit and scope of the water cooler stand. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 2 is a top view of an embodiment of the disclosure.

FIG. 3 is a front view of an embodiment of the disclosure.

DETAILED DESCRIPTION OF THE EMBODIMENT

Figure 1:
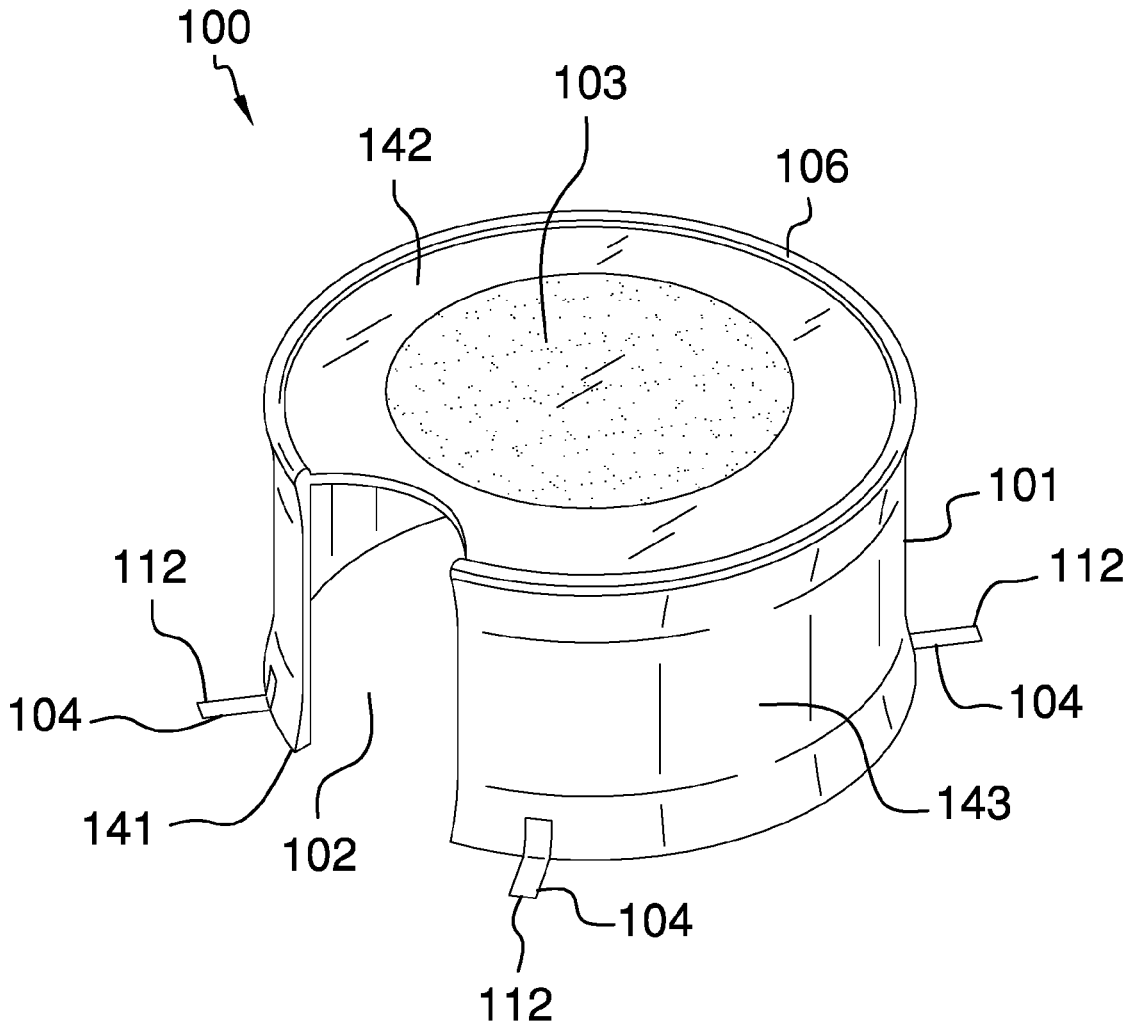
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5.

The water cooler stand 100 (hereinafter invention) comprises a capped cylinder 101, a cup opening 102, a non-skid surface 103, a plurality of hook and loop fasteners 104, a flared edge 105, and a safety edge 106. The invention 100 is adapted for use with a five gallon beverage cooler 131. The five gallon beverage cooler 131 is further defined with a length direction and a diameter direction that correspond to definitions associated with the capped cylinder 101 that are described elsewhere in this disclosure. The invention 100 is a cylindrical structure that is adapted to rest on a resting surface 133 and receive the five gallon beverage cooler 131 such that it raises the five gallon beverage cooler 131 off the resting surface 133. The invention 100 has formed in it a cup opening 102 that is sized to allow a cup to be placed underneath the spigot 132 of the five gallon beverage cooler 131 such that liquids released from the cooler through the spigot 132 will fall into a beverage cup 134 placed underneath the spigot 132. When not in use, the invention 100 can be stored on the five gallon beverage cooler 131.

Figure 5:
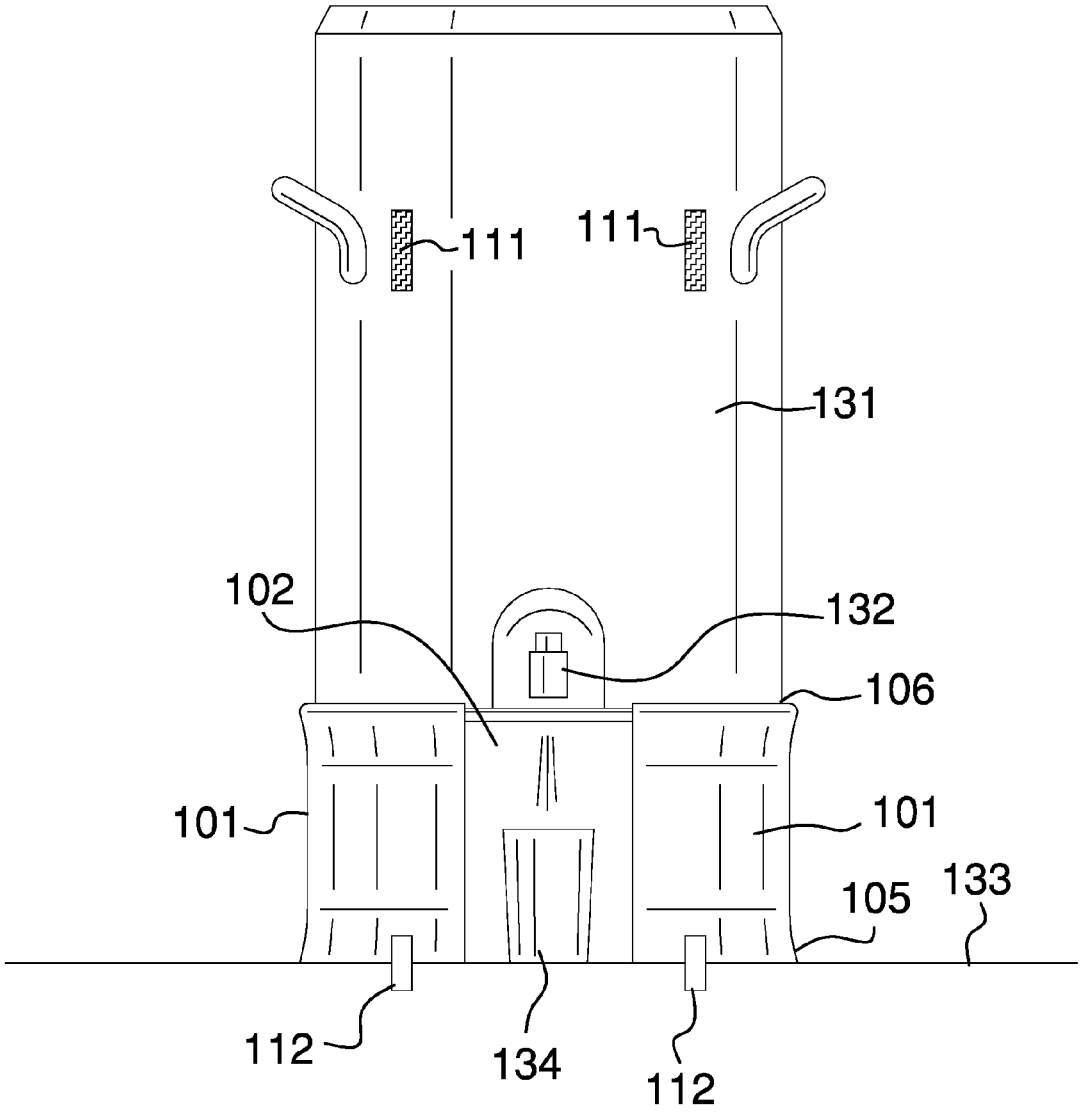
FIG. 5 is an in use view of an embodiment of the disclosure.

The capped cylinder 101 is a cylindrical structure formed from food grade polycarbonate. The capped cylinder 101 is formed in the shape of a capped cylinder that is further defined with an open end 141, a closed end 142, a face 143, a length 144 and a diameter 145. The length 144 direction runs in the direction parallel to the center axis of the capped cylinder 101. The diameter 145 runs in the direction perpendicular the direction of the center axis of the capped cylinder 101. The intended positioning of the capped cylinder 101 during use is to place the open end 141 of the capped cylinder 101 directly on the resting surface 133 upon which the invention 100 is placed. The five gallon beverage cooler 131 is then placed on the closed end 142 of the invention 100 such that the spigot 132 is aligned with the cup opening 102 as shown in FIG. 5. The capped cylinder 101 is sized such that the inner dimension of the diameter 145 of the capped cylinder 101 is greater than the outer dimension of the diameter of the five gallon beverage cooler 131. The length 144 of the capped cylinder 101 is lesser than the length of the five gallon beverage cooler 131.

As shown most clearly in FIGS. 1 and 2, the cup opening 102 is an opening that is formed in the face 143 and closed end 142 of the capped cylinder 101. The cup opening 102 is formed such that a cylindrical segment would fit within the shape formed by the cup opening 102. The span of the length 144 dimension of the cup opening 102 is the same as the length of the capped cylinder 101. When in use, the cup opening 102 permits a beverage cup 134 to be placed on the resting surface 133 such that, assuming the resting surface 133 is level and the beverage cup 134 is properly aligned with the spigot 132, liquids drawn from the five gallon beverage cooler 131 through the spigot 132 will fall into the center of the beverage cup 134.

As shown most clearly in FIG. 2, a non-skid surface 103 is applied to the exterior surface of the closed end 142 of the capped cylinder 101. The non-skid surface 103 prevents the five gallon beverage cooler 131 from sliding while positioned on the invention 100. The non-skid surface 103 can be formed with the capped cylinder 101 or can be applied after the capped cylinder 101 is formed using commercially available skid prevention surface applicators.

Figure 4:
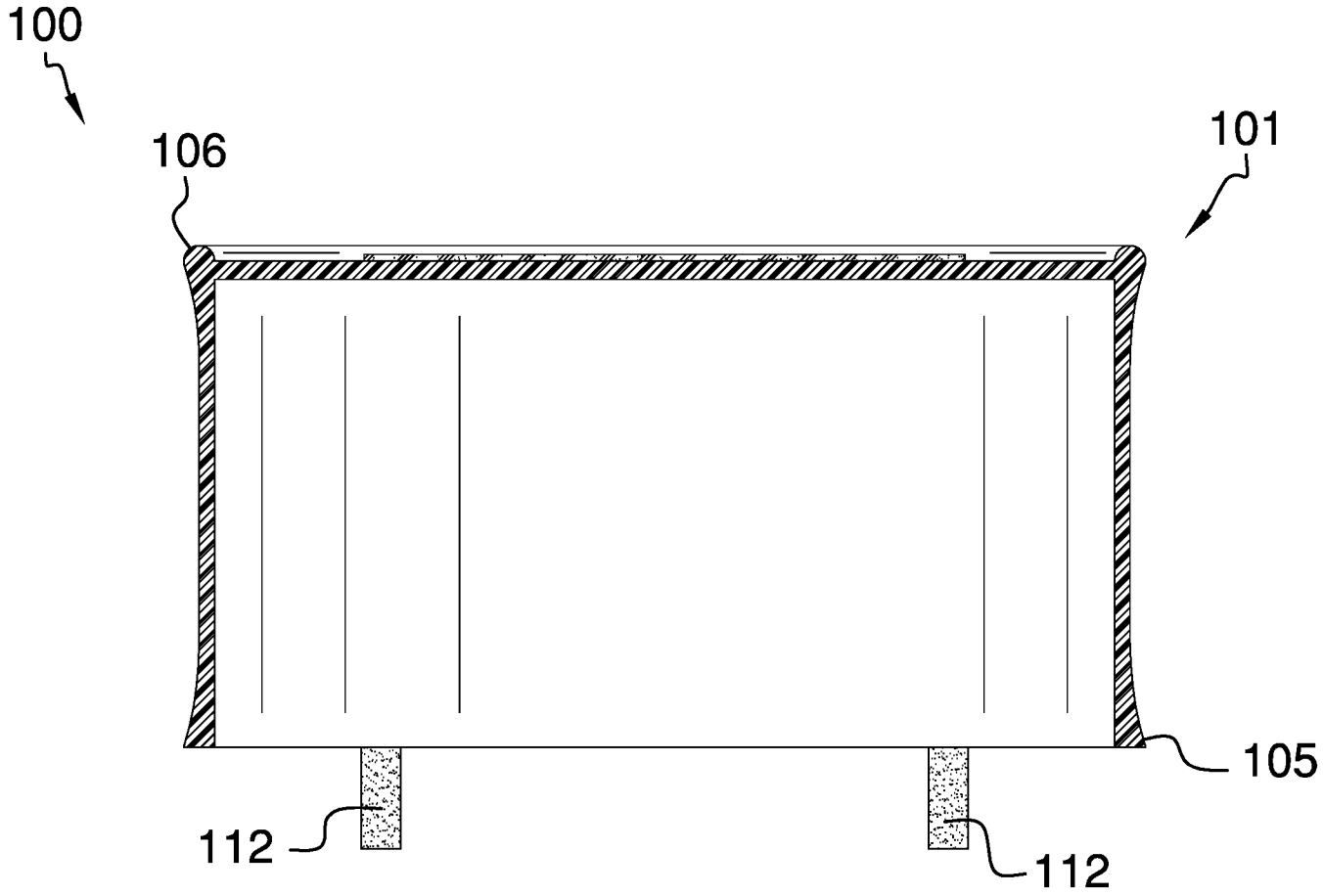
FIG. 4 is a cross-sectional view of an embodiment of the disclosure across 4-4 in FIG. 2.

As shown most clearly in FIGS. 3 and 4, the open end 141 of the capped cylinder 101 is formed with a slightly flared edge 105 that flares away from the center axis of the capped cylinder 101. This is done to strengthen the structural integrity of the invention 100. As shown most clearly in FIGS. 3 and 4, a safety edge 106 is applied to closed end 142 of the capped cylinder 101. The safety edge 106 is a rim that is applied to the perimeter of closed end 142 to prevent liquids accumulated on the closed end 142 of the capped cylinder 101 from spilling onto the resting surface 133.

Each of the plurality of hook and loop fasteners 104 further comprises a first hook or loop surface 111 and a second hook or loop surface 112. The first hook or loop surface 111 is attached using adhesive to the face of the cylinder of the five gallon beverage cooler 131. The second hook or loop surface 112 is attached using adhesive to the face 143 of the capped cylinder 101 in the vicinity of the open end 141 of the capped cylinder 101. The plurality of hook and loop fasteners 104 are used to secure the invention 100 to the five gallon beverage cooler 131 when the invention 100 is not in use. To secure the invention 100 to the five gallon beverage cooler 131 the open end 141 of the capped cylinder 101 is placed over the end of the five gallon beverage cooler 131 that is distal from the spigot 132. Each of the second hook or loop surfaces 112 is pressed against a first hook or loop surface 111 such each of the first hook or loop surfaces 111 has received a second hook or loop surface 112.

The capped cooler 101, the cup opening 102, the flared edge 105, and the safety edge 106 are formed as a single unit from molded plastic. Suitable plastic includes, but is not limited to, food grade polycarbonate. In the first potential embodiment of the disclosure, the remaining components of the invention 100 were readily purchased commercially.

The following definitions were used in this disclosure:

Capped Cylinder: As used in this disclosure, a capped cylinder is a hollow cylinder with one closed end and one open end.

Cylinder: As used in this disclosure, a cylinder is a hollow geometric solid defined by two identical flat, open, and parallel ends that are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Inner Diameter: As used in this disclosure, the term inner diameter is used in the same way that a plumber would refer to the inner diameter of a pipe.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fasten to the plurality of loops securely fastening the hook surface to the loop surface. A note on usage: when fastening a two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook or loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Outer Diameter: As used in this disclosure, the term outer diameter is used in the same way that a plumber would refer to the outer diameter of a pipe.

Perimeter: As used in this disclosure, a perimeter is one or more curved or straight lines that bounds an enclosed area on a plane.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A stand comprising:

a capped cylinder, a cup opening, a non-skid surface, a plurality of hook and loop fasteners, a flared edge, and a safety edge, wherein the capped cylinder is formed with an open end, a closed end, a face, a length and a diameter, and the cup opening is an opening that is formed in the face between the closed end and the open end of the capped cylinder;

wherein the stand is adapted for use with a five gallon beverage cooler;

wherein the stand is a cylindrical structure, rests on a resting surface and receives the five gallon beverage cooler on the closed end such that the stand raises the five gallon beverage cooler off the resting surface;

wherein the cup opening that is sized to allow a cup to be placed underneath a spigot of the five gallon beverage cooler;

wherein the cup opening is sized and positioned such that liquid released from the cooler through the spigot will fall into a beverage cup placed inside the cup opening on the resting surface underneath the spigot;

wherein the open end of the capped cylinder is placed over an end of the five gallon beverage cooler that is distal from the spigot while the stand is in storage and not in use.

2. The stand according to claim 1 wherein the capped cylinder is a cylindrical structure.

3. The stand according to claim 2 wherein the capped cylinder is formed from food grade polycarbonate.

4. The stand according to claim 1 wherein the capped cylinder is sized such that the inner dimension of the diameter of the capped cylinder is greater than the outer dimension of the diameter of the five gallon beverage cooler.

5. The stand according to claim 4 wherein the length of the capped cylinder is lesser than a length of the five gallon beverage cooler.

6. The stand according to claim 5 wherein the cup opening is formed such that a cylindrical segment would fit within the shape formed by the cup opening.

7. The stand according to claim 6 wherein span of a length dimension of the cup opening is equal to the length of the capped cylinder.

8. The stand according to claim 7 wherein the cup opening is sized such that a beverage cup can be placed on the resting surface such that liquids drawn from the five gallon beverage cooler through the spigot will fall into the center of the beverage cup.

9. The stand according to claim 8 wherein the non-skid surface is applied to the exterior surface of the closed end of the capped cylinder.

10. The stand according to claim 9 wherein the open end of the capped cylinder is formed with a flared edge.

11. The stand according to claim 10 wherein the safety edge is applied to closed end of the capped cylinder.

12. The stand according to claim 11 wherein the safety edge is a rim that is applied to the perimeter of closed end.

13. The stand according to claim 12 wherein the plurality of hook and loop fasteners are used to secure the stand to the five gallon beverage cooler.

14. The stand according to claim 13 wherein the capped cylinder, the cup opening, the flared edge, and the safety edge are formed as a single unit from molded plastic.

* * * * *